US006457843B1

(12) United States Patent
Kester et al.

(10) Patent No.: US 6,457,843 B1
(45) Date of Patent: Oct. 1, 2002

(54) OUTLET COVERING SYSTEM

(76) Inventors: Billie-Jo M. Kester, 1510 Townline Rd., Wisconsin Rapids, WI (US) 54494; Ronald D. Kester, 1510 Townline Rd., Wisconsin Rapids, WI (US) 54494

( * ) Notice: Subject to any disclaimer, the term of this patent is extended or adjusted under 35 U.S.C. 154(b) by 0 days.

(21) Appl. No.: 09/802,541

(22) Filed: Mar. 9, 2001

(51) Int. Cl.[7] ..... F21V 33/00; H01R 13/44

(52) U.S. Cl. ..... 362/276; 362/226; 362/95; 362/186; 362/376; 362/802; 439/136; 439/142; 439/147

(58) Field of Search ..... 362/276, 257, 362/226, 95, 186, 351, 376, 802, 269, 311; 439/136, 142, 147

(56) References Cited

U.S. PATENT DOCUMENTS 2,880,264 A * 3/1959 Ruskin ..... 174/48
2,916,733 A * 12/1959 Hirsch ..... 174/67
3,491,327 A 1/1970 Tait et al.
3,739,226 A * 6/1973 Seiter et al. ..... 174/53
4,343,032 A * 8/1982 Schwartz ..... 362/276
4,714,984 A * 12/1987 Spector ..... 362/101
4,915,638 A 4/1990 Domian
D314,831 S 2/1991 Heverly et al.
5,218,169 A * 6/1993 Riceman ..... 174/67
5,264,662 A * 11/1993 Kennedy ..... 174/67
5,465,198 A * 11/1995 Kellogg ..... 362/253
5,495,402 A 2/1996 Houssian
5,533,637 A 7/1996 Williams, Jr.
5,964,516 A * 10/1999 Lai ..... 362/226
6,031,183 A * 2/2000 Guerrieri ..... 174/67

* cited by examiner

*Primary Examiner*—Thomas M. Sember
*Assistant Examiner*—David V. Hobden

(57) ABSTRACT

An outlet covering system for restricting access to an outlet mounted on a wall surface. The outlet covering system includes an enclosure mountable to a wall surface for covering an outlet. The enclosure comprises a plate member that includes an opening for receiving the outlet and a cover member pivotally coupled to the plate member for selectively blocking access to the outlet. The cover member includes a front wall, a top wall, a bottom wall, and a pair of side walls. A securing member is provided for releasably securing the cover member to the plate member. A locking means is provided for selectively locking said cover member in a closed position.

17 Claims, 5 Drawing Sheets

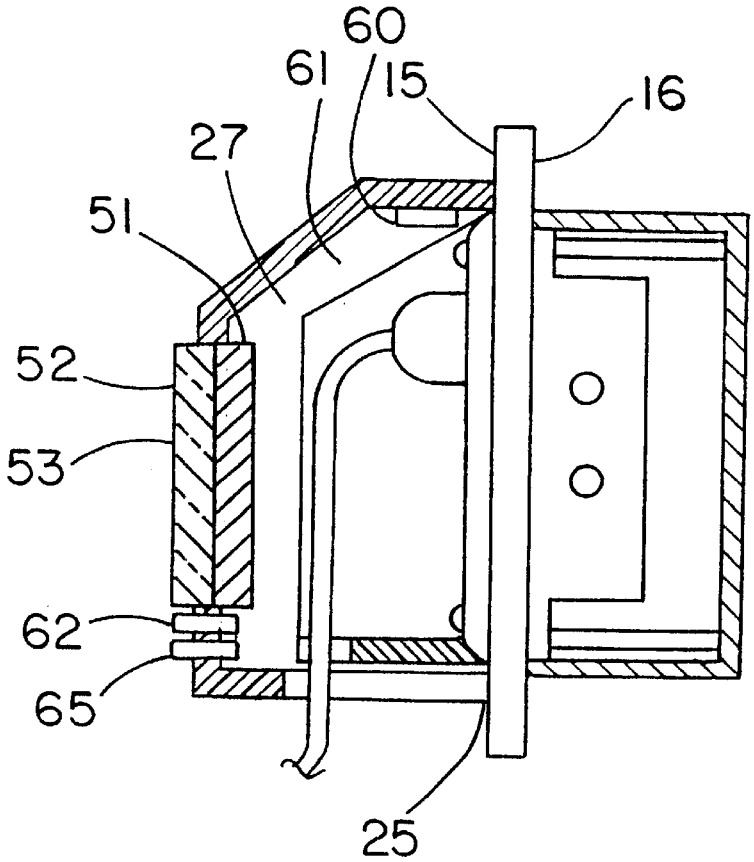
FIG. 3
FIG. 4
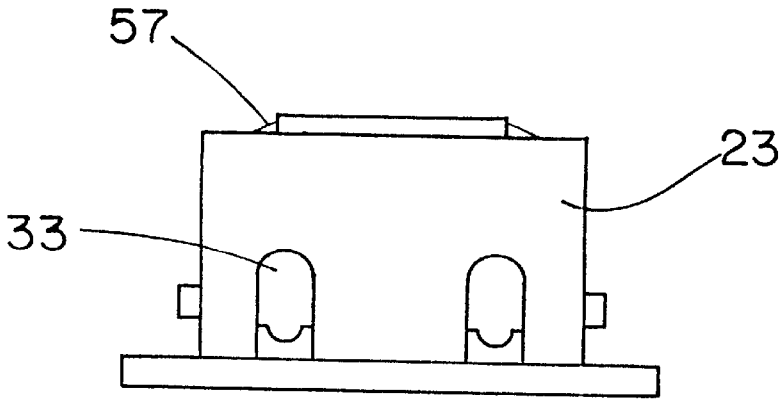

OUTLET COVERING SYSTEM

BACKGROUND OF THE INVENTION

1. Field of the Invention

The present invention relates to outlet covers and more particularly pertains to a new outlet covering system for restricting access to an outlet mounted on a wall surface.

2. Description of the Prior Art

The use of outlet covers is known in the prior art. More specifically, outlet covers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,915,638; U.S. Pat. No. 5,495,402; U.S. Pat. No. 5,533,637; U.S. Pat. No. 3,739,226; U.S. Pat. No. Des. 314,831; and U.S. Pat. No. 3,491,327.

While these devices fulfill their respective, particular objectives and requirements, the aforementioned patents do not disclose a new outlet covering system. The inventive device includes an enclosure mountable to a wall surface for covering an outlet. The enclosure comprises a plate member that includes an opening for receiving the outlet and a cover member pivotally coupled to the plate member for selectively blocking access to the outlet. The cover member includes a front wall, a top wall, a bottom wall, and a pair of side walls. A securing member is provided for releasably securing the cover member to the plate member. A locking means is provided for selectively locking said cover member in a closed position.

In these respects, the outlet covering system according to the present invention substantially departs from the conventional concepts and designs of the prior art, and in so doing provides an apparatus primarily developed for the purpose of restricting access to an outlet mounted on a wall surface.

SUMMARY OF THE INVENTION

In view of the foregoing disadvantages inherent in the known types of outlet covers now present in the prior art, the present invention provides a new outlet covering system construction wherein the same can be utilized for restricting access to an outlet mounted on a wall surface.

The general purpose of the present invention, which will be described subsequently in greater detail, is to provide a new outlet covering system apparatus and method which has many of the advantages of the outlet covers mentioned heretofore and many novel features that result in a new outlet covering system which is not anticipated, rendered obvious, suggested, or even implied by any of the prior art outlet covers, either alone or in any combination thereof.

To attain this, the present invention generally comprises an enclosure mountable to a wall surface for covering an outlet. The enclosure comprises a plate member that includes an opening for receiving the outlet and a cover member pivotally coupled to the plate member for selectively blocking access to the outlet. The cover member includes a front wall, a top wall, a bottom wall, and a pair of side walls. A securing member is provided for releasably securing the cover member to the plate member. A locking means is provided for selectively locking said cover member in a closed position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new outlet covering system apparatus and method which has many of the advantages of the outlet covers mentioned heretofore and many novel features that result in a new outlet covering system which is not anticipated, rendered obvious, suggested, or even implied by any of the prior art outlet covers, either alone or in any combination thereof.

It is another object of the present invention to provide a new outlet covering system which may be easily and efficiently manufactured and marketed.

It is a further object of the present invention to provide a new outlet covering system which is of a durable and reliable construction.

An even further object of the present invention is to provide a new outlet covering system which is susceptible of a low cost of manufacture with regard to both materials and labor, and which accordingly is then susceptible of low prices of sale to the consuming public, thereby making such outlet covering system economically available to the buying public.

Still yet another object of the present invention is to provide a new outlet covering system which provides in the apparatuses and methods of the prior art some of the advantages thereof, while simultaneously overcoming some of the disadvantages normally associated therewith.

Still another object of the present invention is to provide a new outlet covering system for restricting access to an outlet mounted on a wall surface.

Yet another object of the present invention is to provide a new outlet covering system which includes an enclosure mountable to a wall surface for covering an outlet. The enclosure comprises a plate member that includes an opening for receiving the outlet and a cover member pivotally coupled to the plate member for selectively blocking access to the outlet. The cover member includes a front wall, a top wall, a bottom wall, and a pair of side walls. A securing member is provided for releasably securing the cover member to the plate member. A locking means is provided for selectively locking said cover member in a closed position.

Still yet another object of the present invention is to provide a new outlet covering system that restricts access to an outlet by a individual such as a child who may be injured by the outlet.

Even still another object of the present invention is to provide a new outlet covering system that that can audibly alert an individual in a supervisory position that another individual is near the outlet. The present invention also provides light in an immediate vicinity in order to allow a user to find their way around in a dimly light or dark area.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic cross-sectional view of the present invention taken along line 3—3 of FIG. 1.

FIG. 4 is a schematic bottom view of the present invention showing a pair of channels for receiving a cord of an electrically powered device.

DESCRIPTION OF THE PREFERRED EMBODIMENT

Figure 1:
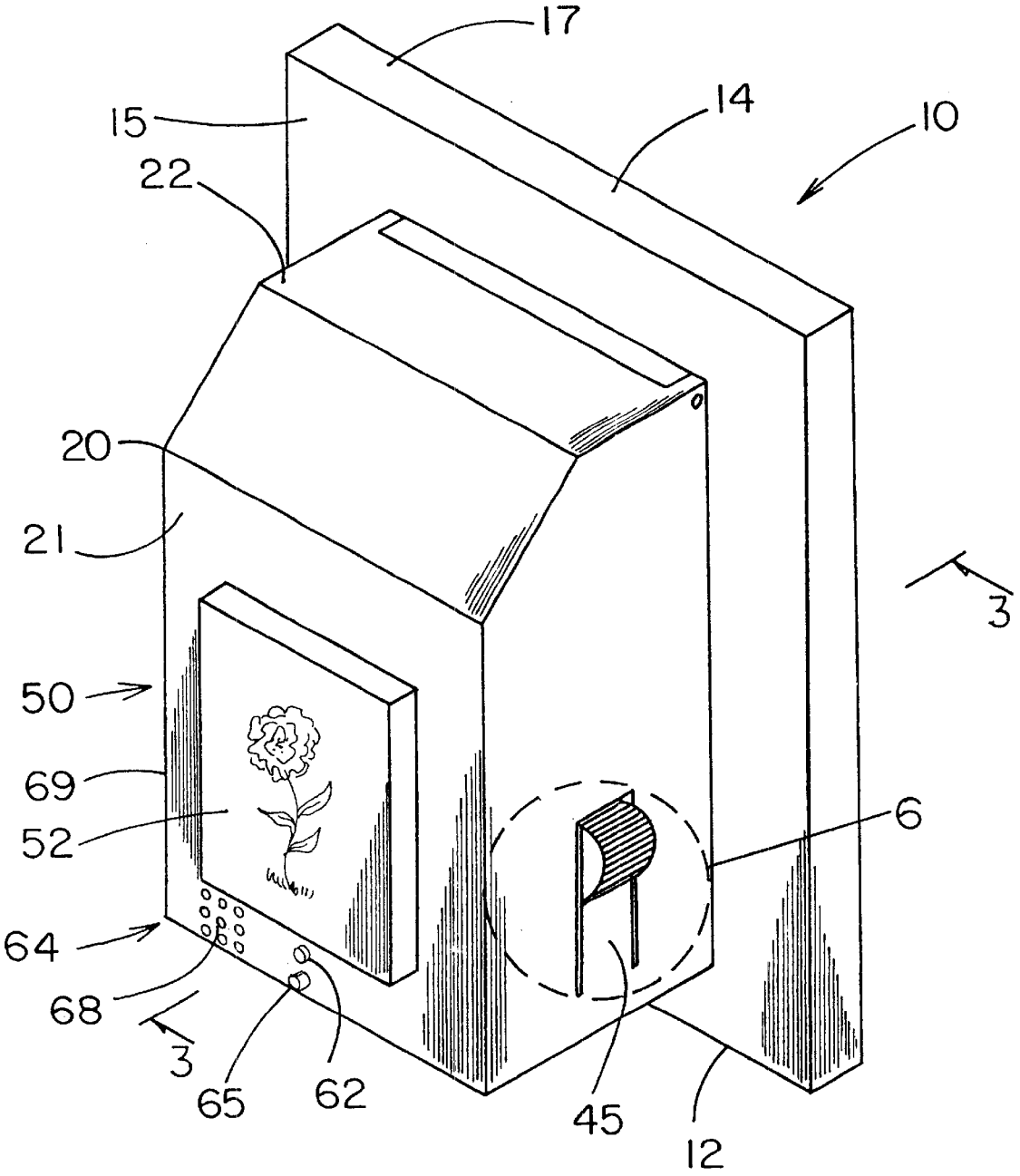
FIG. 1 is a schematic perspective view of a new outlet covering system according to the present invention showing an enclosure in a closed condition.

With reference now to the drawings, and in particular to FIGS. 1 through 8 thereof, a new outlet covering system embodying the principles and concepts of the present invention and generally designated by the reference numeral 10 will be described.

Figure 7:
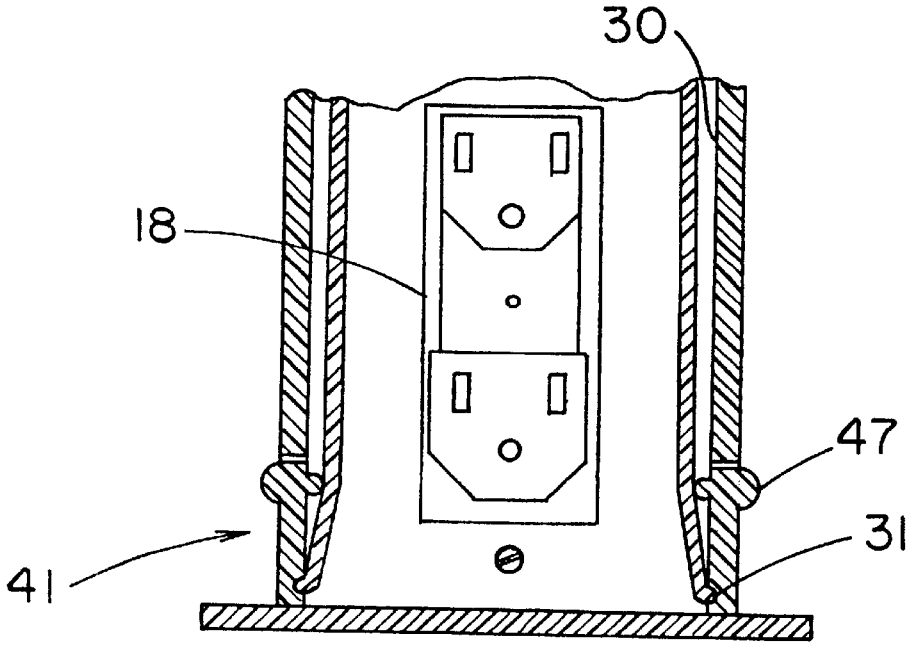
FIG. 7 is a schematic cross-sectional view of the present invention showing taken along line 7—7 of FIG. 5.

As best illustrated in FIGS. 1 through 8, the outlet covering system 10 generally comprises an enclosure 12 for covering the outlet. The enclosure 12 is mountable to the wall surface includes having the outlet. The enclosure 12 preferably comprises a plate member 14 that, as particularly illustrated in FIG. 3, has a front surface 15, a back surface 16 and a peripheral edge 17. As illustrated in FIG. 7, the plate member 14 includes an openings has a pair of channels 38 extending therein for receiving a cord of an electrical device that is plugged in the outlet. Each of the channels 38 of the base wall portion 36 extends from an edge 39 of the base wall portion toward the front surface 15 of the plate member 14. Each of the channels 33 of the cover member 20 is axially alignable with the channels 38 of the securing member 35 such that the outlet may be used while access to the outlet is restricted. In one embodiment of the present invention, a width of an end 40 of each of the side wall portions 37 tapers toward the front surface 15 of the plate member 14 such that the securing member 35 does not hinder the closing of the cover member 20.

A locking means 41 is provided for selectively locking the cover member 20 in the closed position. The locking means 41 preferably comprises an inner depressible tab 42 formed on each of the pair of side wall portions 37 of the securing member 35. An end 43 of each of the inner tabs 42 includes a lip 44 formed thereon for selectively engaging one of a pair of grooves 31 extending in an inner surface 30 of the cover member 20 when the cover member 20 is in the closed position. An outer depressible tab 45 is formed on each of the pair of side walls 24 of the cover member 20 for selectively engaging the inner tabs 42. An outer surface 46 of each of the outer tabs 45 may include a protruding portion 47 formed thereon. Each of the protruding portions 47 is positioned generally adjacent to an end 48 of each of the outer tabs 45. When a user depresses the protruding portion 47 of each of the outer tabs 45, each of the outer tabs 45 engages a respective inner tab 42, withdrawing the lip 44 of each of the inner tabs 42 from each of the grooves 31, wherein the cover member 20 may be pivotally opened providing access to the outlet. 18 for receiving the outlet. The opening 18 extends through the front 15 and back 16 surfaces of the plate member 14. The plate member 14 may also be manufactured having a pair of openings 18 for selectively receiving an outlet adapted for being inserted in a plate member 14 having two openings 18.

A cover member 20 is pivotally coupled to the plate member 14 for selectively blocking access to the outlet. The cover member 20 is positionable between an open position and a closed position, wherein the closed position is characterized by the cover member 20 blocking access to the outlet. The open position is characterized by the cover member 20 not blocking access to the outlet. The cover member 20 preferably includes a front wall 21, a top wall 22, a bottom wall 23 and a pair of side walls 24. An edge 25 of the top 22, bottom 23 and pair of side walls 24 define an opening 26 extending into a cavity 27 of the cover member 20. As illustrated in FIG. 1, a width of the pair of side walls 24 may taper from a central portion of the cover member 20 toward the top wall 22 of the cover member 20. The bottom wall 23 of the cover member 20 preferably includes a pair of channels 33 extending therein for removably receiving a cord of an electrical device plugged in the outlet. Each of the channels 33 extends from the edge 25 of the bottom wall 23 toward the front wall 21 of the cover member 20.

Figure 2:
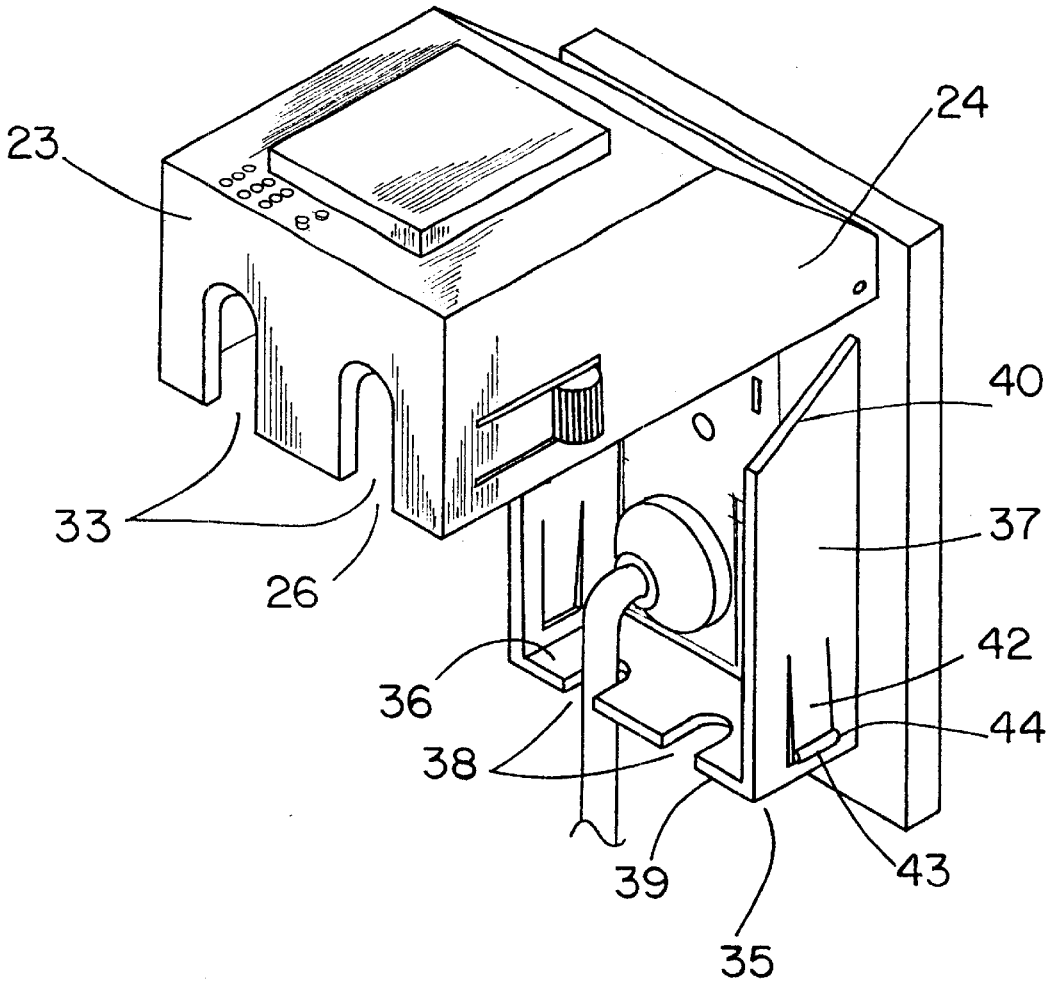
FIG. 2 is a schematic perspective view of the present invention showing the enclosure in an open condition.
Figure 5:
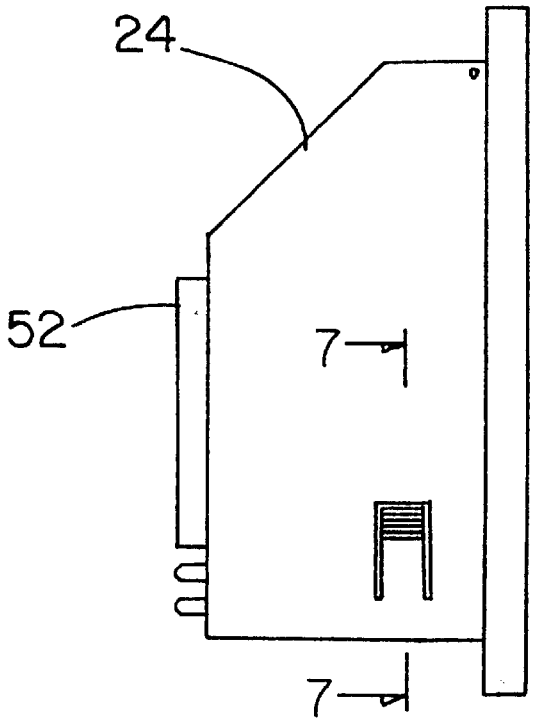
FIG. 5 is a schematic side view of the present invention.
Figure 6:
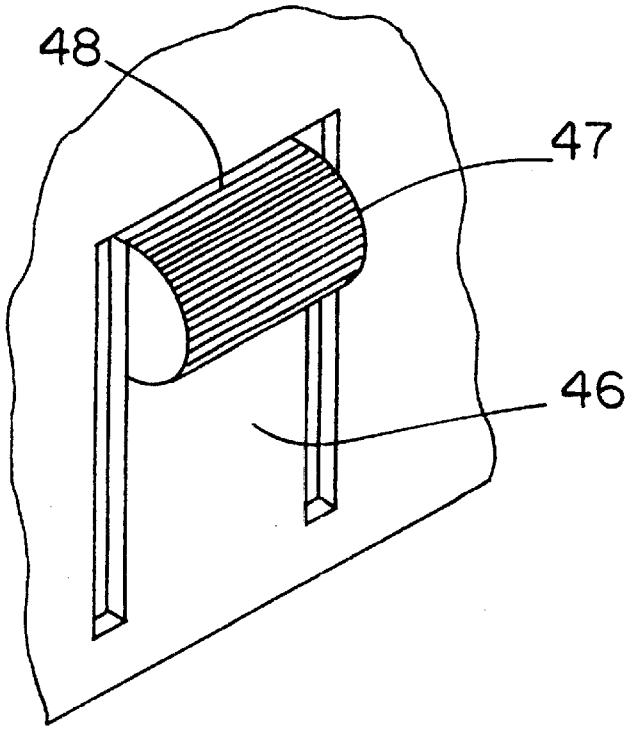
FIG. 6 is a schematic perspective view of the present invention showing an outer tab used to open the enclosure.
Figure 8:
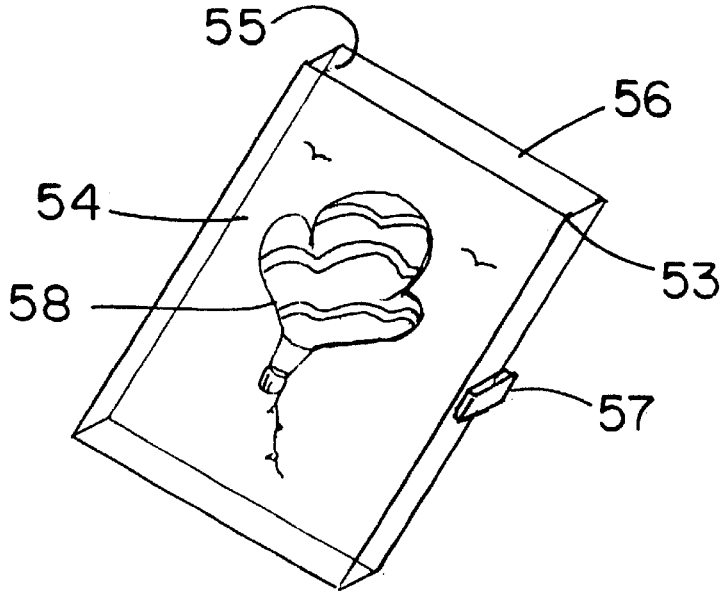
FIG. 8 is a schematic perspective view of the present invention showing a shade that covers a light of the enclosure.

As illustrated in FIG. 2, a securing member 35 may be provided for releasably securing the cover member 20 to the plate member 14. The securing member 35 is mounted on the front surface 15 of the plate member 14. The securing member 35 may comprise a base wall portion 36 and a pair of side wall portions 37 orientated generally perpendicular to the base wall portion 36. In one embodiment of the present invention, the base wall portion 36

As illustrated in FIG. 3, a light assembly 50 may be mounted on the front wall 21 of the cover member 20. The light assembly may comprise a light 51 for illuminating an area around the enclosure 12. The light 51 is mounted on the front wall 15 of the cover member 20 and is electrically connectable to the outlet. The light 51 may comprise any light such as, for example, a light bulb.

A shade 52 may be provided for selectively covering the light 51. The shade 52 preferably comprises a translucent panel 53 that includes a front surface 54, a back surface 55 and a perimeter edge 56. The perimeter edge 56 of the panel 53 includes a pair of protruding portions 57 formed thereon for removably mounting the panel 53 to the front wall 21 of the cover member 20. Each of the protruding portions 57 is selectively insertable in the front wall 21 of the cover member 20. Indicia 58 may be marked on the front surface 53 of the shade 52. The indicia 58 is illuminated by the light 51 when the light is illuminated. The indicia 58 may comprise any indicia such as, for example, flowers, horses, balloons, and angels.

As illustrated in FIG. 3, an auxiliary power supply 60 may be provided for supplying power to the light 51. The auxiliary power supply 60 may be mounted on an inner surface 61 of the top wall 22 of the cover member 20. The auxiliary power supply 60 is electrically connected to the light 51.

A light sensor switch 62 may be provided for detecting an absence of light such as the onset of darkness in the evening. The light sensor switch 62 is mounted on the front wall 21 of the cover member 20. The light sensor switch 62 is preferably positioned generally adjacent to the shade 52. In one embodiment of the present invention, the light sensor switch 62 selectively provides power to the light 51 when the light sensor switch 62 detects an absence of light. The light sensor switch 62 is electrically connected to the auxiliary power supply 60 and operationally coupled to the light 51. The light sensor switch 62 may also be electrically connectable to the outlet.

An alarm assembly 64 may be mounted on the front wall 21 of the cover member 20. The alarm assembly 64 may comprise a motion sensor switch 65 for detecting movement near the motion sensor switch 65. The motion sensor switch 65 is mounted on the front wall 21 of the cover member 20. The motion sensor switch 65 is preferably positioned generally adjacent to the light sensor switch 62. The motion sensor switch 65 is electrically coupled to the auxiliary power supply 60 and may be electrically connectable to the outlet.

A speaker 68 may be provided for emitting a sound. The speaker 68 is mounted on the front wall 21 of the cover member 20 and is preferably positioned generally between the motion sensor switch 65 and a lateral edge 69 of the cover member 20. The speaker 68 is electrically connected to the auxiliary power supply 60 and is operationally coupled to the motion sensor switch 65. In one embodiment of the present invention, movement detected from the motion sensor switch 65 selectively provides power to the speaker 68 to emit a sound such as, for example, a dog barking, or a person audibly stating a warning.

In use, the cord of an electrically powered device is plugged into the outlet and the cover member 20 is pivotally positioned in the closed position such that it blocks access to the outlet. To gain access to the outlet, a user must depress both outer tabs 45, which will depress the inner tabs 42 releasing the cover member 20 from the securing member 35 positioning the cover member 20 in the open position.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An outlet covering system for restricting access to an outlet mounted on a wall surface, said system comprising:

an enclosure for covering the outlet, said enclosure being mountable to the wall surface having the outlet, said enclosure comprising:

a plate member having an opening for receiving the outlet;

a cover member pivotally coupled to said plate member for selectively blocking access to the outlet, said cover member having a front wall, a top wall, a bottom wall, and a pair of side walls;

a securing member for releasably securing said cover member to said plate member, said securing member comprising a base wall portion and a pair of side wall portions; and a locking means for selectively locking said cover member in a closed position, said locking means comprising an inner depressible tab formed on each of said pair of side wall portions of said securing member, an end of each of said inner tabs having a lip formed thereon for selectively engaging one of a pair of grooves formed on said cover member when said cover member is in said closed position, and an outer finger depressible tab being formed on each of said side walls of said cover member, said outer finger depressible tabs selectively abutting said inner tabs when a user depresses inwardly on an end of each of said outer finger depressible tabs such that said lips of said inner tabs are withdrawn from said grooves.

2. The outlet covering system of claim 1, wherein said plate member has a front surface, a back surface and a peripheral edge, said opening extending through said front and back surfaces.

3. The outlet covering system of claim 1, wherein an edge of said top, bottom, and pair of side walls of said cover member defines an opening extending into a cavity of said cover member.

4. The outlet covering system of claim 1, wherein a width of said pair of side walls of said cover member tapers from a central portion of said cover member toward said top wall of said cover member.

5. The outlet covering system of claim 1, wherein said bottom wall of said cover member has a pair of channels extending therein for removably receiving a cord of an electrical device plugged in the outlet, each of said channels extending from an edge of said bottom wall toward said front wall.

6. The outlet covering system of claim 1, wherein said base wall portion has a pair of channels extending therein for receiving a cord of an electrical device being plugged in the outlet, each of said channels of said base wall portion extending from an edge of said base wall portion toward said front surface of said plate member, each of said channels of said cover member being axially aligned with said channels of said securing member.

7. The outlet covering system of claim 1, wherein a width of an end of each of said side wall portions tapers toward said front surface of said plate member.

8. The outlet covering system of claim 1, wherein an outer surface of each of said outer finger depressible tabs has a protruding portion formed thereon positioned generally adjacent to said end of each of said outer finger depressible tabs.

9. The outlet covering system of claim 1, additionally including a light assembly being mounted on said front wall of said cover member, said light assembly comprising a light mounted on said front wall of said cover member for illuminating an area around said enclosure.

10. The outlet covering system of claim 9, additionally including a shade for selectively covering said light, said shade comprising a translucent panel having a pair of protruding portions formed thereon for removably mounting said panel to said front wall of said cover member.

11. The outlet covering system of claim 10, additionally including indicia being marked on a front surface of said shade, said indicia being illuminated by said light.

12. The outlet covering system of claim 9, additionally including an auxiliary power supply for supplying power to said light, said auxiliary power supply being mounted on said cover member.

13. The outlet covering system of claim 9, additionally including a light sensor switch mounted on said cover member for detecting an absence of light, wherein said light sensor switch selectively provides power to said light when said light sensor switch detects an absence of light.

14. The outlet covering system of claim 1, additionally including an alarm assembly being mounted on said front wall of said cover member for detecting movement.

15. The outlet covering system of claim 14, wherein said alarm assembly comprises:

a motion sensor switch mounted on said front wall of said cover member; and a speaker for emitting a sound, said speaker being mounted on said front wall of said cover member and operationally coupled to said motion sensor switch, wherein movement detected from said motion sensor switch selectively provides power to said speaker to emit said sound.

16. The outlet covering system of claim 1, wherein said closed position is characterized by said cover member blocking access to the outlet, an open position of said cover member is characterized by said cover member not blocking access to the outlet.

17. An outlet covering system for restricting access to an outlet mounted on a wall surface, said system comprising:

an enclosure for covering the outlet, said enclosure being mountable to the wall surface having the outlet, said enclosure comprising:

a plate member having a front surface, a back surface and a peripheral edge, said plate member having an opening extending through said front and back surfaces for receiving the outlet;

a cover member pivotally coupled to said plate member for selectively blocking access to the outlet, said cover member being positionable between an open position and a closed position, wherein said closed position is characterized by said cover member blocking access to the outlet, wherein said open position is characterized by said cover member being not blocking access to the outlet, said cover member having a front wall, a top wall, a bottom wall, and a pair of side walls, an edge of said top, bottom, and pair of side walls defining an opening extending into a cavity of said cover member, a width of said pair of side walls tapering from a central potion of said cover member toward said top wall of said cover member, said bottom wall of said cover member having a pair of channels extending therein for removably receiving a cord of an electrical device plugged in the outlet, each of said channels extending from said edge of said bottom wall toward said front wall;

a securing member for releasably securing said cover member to said plate member, said securing member being mounted on said front surface of said plate member, said securing member comprising a base wall portion and a pair of side wall portions, wherein said base wall portion has a pair of channels extending therein for receiving a cord of an electrical device being plugged in the outlet, each of said channels of said base wall portion extending from an edge of said base wall portion toward said front surface of said plate member, each of said channels of said cover member being axially aligned with said channels of said securing member, wherein a width of an end of each of said side wall portions tapers toward said front surface of said plate member;

a locking means for selectively locking said cover member in said closed position, said locking means comprising an inner depressible tab formed on each of said pair of side wall portions of said securing member, an end of each of said inner tabs having a lip formed thereon for selectively engaging one of a pair of grooves extending in an inner surface of said cover member, an outer finger depressible tab being formed on each of said pair of side walls of said cover member, said outer finger depressible tabs selectively abutting said inner tabs when a user depresses inwardly on an end of each of said outer finger depressible tabs such that said lips of said inner tabs are withdrawn from said grooves, an outer surface of each of said outer finger depressible tabs having a protruding portion formed thereon, each of said protruding portions being positioned generally adjacent to an end of each of said outer finger depressible tabs, wherein said cover member may be pivotally opened providing access to the outlet;

a light assembly being mounted on said front wall of said cover member, said light assembly comprising:

a light for illuminating an area around said enclosure, said light being mounted on said front wall of said cover member, said light being electrically connectable to the outlet;

a shade for selectively covering said light, said shade comprising a translucent panel having a front surface, a back surface and a perimeter edge, said perimeter edge of said panel having a pair of protruding portions formed thereon for removably mounting said panel to said front wall of said cover member, each of said protruding portions being selectively insertable in said front wall of said cover member;

indicia being marked on a front surface of said shade, said indicia being illuminated by said light;

an auxiliary power supply for supplying power to said light, said auxiliary power supply being mounted on an inner surface of said top wall of said cover member, said auxiliary power supply being electrically connected to said light;

a light sensor switch for detecting an absence of light, said light sensor switch being mounted on said front wall of said cover member, said light sensor switch being positioned generally adjacent to said shade, wherein said light sensor switch selectively provides power to said light when said light sensor switch detects an absence of light, said light sensor switch being electrically connected to said auxiliary power supply and operationally coupled to said light;

an alarm assembly being mounted on said front wall of said cover member, said alarm assembly comprising:

a motion sensor switch for detecting movement, said motion sensor switch being mounted on said front wall of said cover member, said motion sensor switch being positioned generally adjacent to said light sensor, said motion sensor switch being electrically coupled to said auxiliary power supply; and a speaker for emitting a sound, said speaker being mounted on said front wall of said cover member, said speaker being positioned generally between said motion sensor and a lateral edge of said cover member, said speaker being electrically connected to said auxiliary power supply and operationally coupled to said motion sensor switch, wherein movement detected from said motion sensor switch selectively provides power to said speaker to emit said sound.

* * * * *